United States Patent [19]

Knapp

[11] 4,031,906

[45] June 28, 1977

[54] WATER PIPE

[76] Inventor: Lawrence Robert Knapp, 122 W. Edna St., Munhall, Pa. 15120

[22] Filed: Mar. 1, 1976

[21] Appl. No.: 662,515

Related U.S. Application Data

[63] Continuation of Ser. No. 528,279, Nov. 29, 1974, abandoned, which is a continuation of Ser. No. 432,908, Jan. 14, 1974, abandoned.

[52] U.S. Cl. ..... 131/173

[51] Int. Cl.[2] ..... A24F 1/14

[58] Field of Search ..... 131/173, 193

[56] References Cited

UNITED STATES PATENTS

| | | | |
|---|---|---|---|
| 183,626 | 10/1876 | Bingham | 131/173 |
| 1,609,609 | 11/1928 | Zane | 131/173 |
| 2,690,753 | 10/1954 | Jackson | 131/173 |
| 2,986,146 | 5/1961 | Li | 131/173 X |
| 3,209,765 | 10/1965 | Shih | 131/173 |
| 3,308,834 | 3/1967 | Furedy | 131/196 |
| 3,410,281 | 11/1968 | Ephron et al. | 131/173 |

FOREIGN PATENTS OR APPLICATIONS

| | | | |
|---|---|---|---|
| 828,933 | 1/1952 | Germany | 131/173 |
| 18,854 | 1910 | United Kingdom | 131/173 |

*Primary Examiner*—Robert W. Michell
*Assistant Examiner*—V. Millin
*Attorney, Agent, or Firm*—Carothers and Carothers

[57] ABSTRACT

A unitary compact water pipe construction wherein a chamber is provided in the solid unitary pipe body and the pipe stem bore communicates with this chamber. A liquid container having a top opening or mouth is provided in sealed engagement with the chamber such that the interior of the container is exposed to the chamber in a sealed relationship, and a tube communicates the interior of the pipe bowl with the interior of the container. Portions of the container are transparent so that the interior of the container is revealed through the walls of the unitary pipe body, and an access is provided to gain access to the interior of the container in order to fill the same with water or some other desired liquid.

1 Claim, 1 Drawing Figure

WATER PIPE

This is a continuation of application Ser. No. 528,279 filed Nov. 29, 1974 now abandoned; which application is a continuation of original parent application Ser. No. 432,908, filed Jan. 14, 1974, now abandoned.

BACKGROUND OF THE INVENTION

This invention relates broadly to tobacco pipes and more particularly to water pipes of the type in which the smoke is passed from the tobacco bowl through a liquid containing reservoir and thence to the mouth of the user.

While the concept of compact water pipes capable of being held in the hand is not new per se, it will nevertheless become obvious from a review of the prior art that such liquid cooled smoking pipes heretofore developed are very complex in their structure and are therefore expensive to manufacture and maintain.

In addition, such water pipes heretofore invented do not provide the smoker with the entertainment of being able to see the inner operation of the pipe in use.

As an example of such prior art pipes, reference is made to the following U.S. Patents: Zane, No. 1,690,609; Shih, No. 3,209,765; and Jackson No. 2,690,753.

It will be noted that each of these prior art pipes is relatively complex in design, as they require a number of intricate pieces to be assembled together thereby making them relatively expensive to manufacture and market.

SUMMARY OF THE INVENTION

It is the object of the present invention to greatly simplify the water pipe structures of the prior art thereby making them easier and less expensive to manufacture, and in addition to construct a compact water pipe which is more interesting to smoke and appealing to the smoker by permitting one to visually watch the inner workings of the pipe as it is being smoked.

The water pipe of the present invention generally comprises a solid unitary pipe body with an upwardly open pipe bowl which is an integral part of the pipe body. A chamber is provided in the pipe body and a pipe stem extends from the pipe body and has a bore therethrough which communicates with the aforesaid chamber. The pipe is also provided with a liquid container having a top mouth in sealed communication with the aforesaid chamber, and in addition has transparent portions revealing the interior of the container through the walls of the pipe body. A tube means communicates the interior of the bowl with the interior of the container which is at least partially filled with water or other desired liquids thereby submerging the exit of the tube means into the container, so that when the smoker draws on the stem, the smoke from the bowl is forced through the tube means and filtered through the water or liquid into the chamber and then into the mouth of the smoker through the stem bore. The pipe is also provided with sealed access means which provides a resealable access to the interior of the container in order to fill the same with the desired liquid.

In one embodiment of the pipe of the present invention, the transparent container is positioned adjacent the bowl in the pipe body between the stem and the bowl, and in a second embodiment, the transparent container is threadably received in the bottom of the pipe body underneath the pipe bowl.

BRIEF DESCRIPTION OF THE DRAWINGS

Other objects and advantages appear in the following description and claims.

The accompanying drawings show, for the purpose of exemplification without limiting the invention or the claims thereto, certain practical embodiments illustrating the principles of this invention wherein:

DETAILED DESCRIPTION OF THE DRAWINGS

Figure 1:
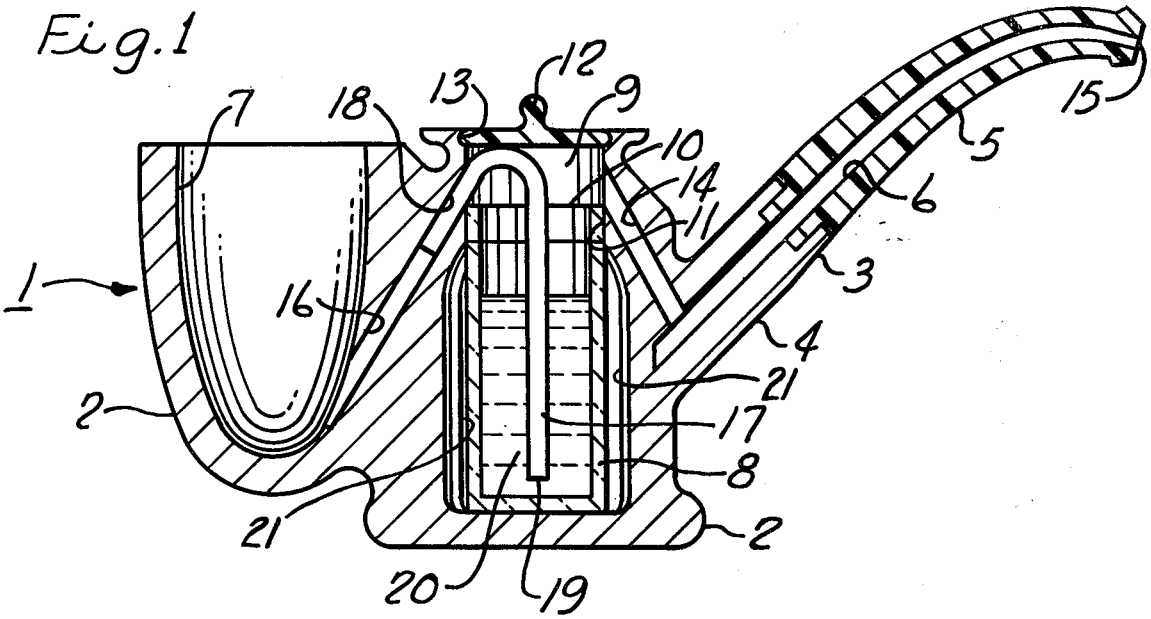
FIG. 1 is a sectional view in side elevation of one embodiment of the water pipe structure of the present invention.

Referring to FIG. 1, the water pipe 1 consists of a unitary wood body 2, preferably constructed of English Briar or some other suitable pipe wood, and pipe stem 3 composed of the wooden shank portion 4 and the plastic mouthpiece 5. The stem 3 has a bore 6 therethrough as indicated.

The unitary pipe body 2 is provided with an upwardly open pipe bowl 7 which is bored directly into the pipe body and intermediate the stem 3 and the pipe bowl 7 is situated a transparent plastic liquid or water container 8.

It should be noted that side portions of the pipe body 2 are removed as indicated by opening 21 so that portions of the container 8 are exposed in order that one may view the interior of the transparent container 8.

A draw chamber 9 is bored into the top of the pipe body 2 and in this instance is the same diameter as the outside diameter of cylindrical container 8. The mouth 10 of cylindrical container 8 is provided in a sealed relationship with the chamber 9 due to the tight fit between the outside top or upper edge of the container 8 and the bottom inside annular edge of the chamber 9 as indicated at 11. The container 8 is preferably glued directly to the chamber walls 9 in order to provide an air tight permanent fit therebetween.

Chamber 9 is provided with a lid 12 which is made of plastic or any other suitable material and which seals the chamber 9 in an air tight manner by the snap fit indicated at 13.

The bore 6 of stem 3 is communicated with the chamber 9 via passage or bore 14 in order to permit smoke to be drawn from the chamber 9 through the stem bore 6 so that it may exit at the opening 15 of the mouthpiece 5.

The pipe bowl 7 communicates with the interior of the transparent container 8 by means of the combination of bore 16 and tubing 17 which is received in bore 16 with an air tight fit as indicated at 18. Tube 17 may be a flexible plastic or a rigid metal tubing as desired. If tube 17 is a flexible plastic, it is preferable that it be glued at 18 in the bore 16 as the tube 17 may be readily cleaned along with bore 16 by merely removing lid 12 and pulling the flexible tube 17 from the interior of container 8 and forcing a pipe cleaner therethrough. If the tube 17 is constructed of a rigid metal, it may merely be provided with a force fit at 18 in bore 16 and then removed for cleaning as desired.

The exposed end 19 of tube 17 rests near the bottom of container 8 which is filled with water 20 to the level indicated.

When the smoker draws on the mouthpiece 5 at the opening 15 with his mouth, this creates a partial vacuum in chamber 9 thereby causing the smoke being created in bowl 7 from ignited tobacco to pass through bore 16 and tube 17 such that it exits at the tube end 19 into the water 20. This combination of smoke and air then rises to the water 20 and exits into chamber 9 and passes on through bore 14 and 6 to the smoker's mouth. One can readily view the filtering of the smoke through the water 20 as the smoker draws on the pipe through the side opening 21 in one-piece body 2 thereby creating an interesting conversation piece.

I claim:

1. A water pipe comprising a solid one-piece pipe body with an upwardly open pipe bowl integrally formed therein, an upwardly open cylindrical chamber in said solid one-piece body beside said bowl with the cylindrical axis of said chamber also extending upwardly, a pipe stem extending from said body and having a passage therethrough communicating with said chamber, an upwardly open transparent liquid container received within said body and having a cylindrical upwardly open end received within said chamber below the point of communication of said passage with said chamber and in sealed relationship therewith for the full perimeter of said container end, said transparent liquid container having side wall portions thereof exposed through an opening in the walls of said body to the exterior, tube means communicating the interior of said bowl with the interior of said container, and removable access means independent of said tube means and sealing the upwardly open end of said chamber without obstructing the open communication of said passage with said chamber to provide access to the interior of said chamber and said container.

* * * * *